United States Patent [19]

Balk

[11] Patent Number: 4,813,864

[45] Date of Patent: Mar. 21, 1989

[54] APPARATUS FOR MAKING A SPUN-FILAMENT FLEECE

[75] Inventor: Hermann Balk, Troisdorf, Fed. Rep. of Germany

[73] Assignee: Reifenhauser GmbH & Co. Maschinenfabrik, Troisdorf, Fed. Rep. of Germany

[21] Appl. No.: 124,255

[22] Filed: Nov. 23, 1987

[30] Foreign Application Priority Data

Apr. 25, 1987 [DE] Fed. Rep. of Germany ..... 3713859

[51] Int. Cl.[4] ..... B29C 47/34

[52] U.S. Cl. ..... 425/66; 264/211.14; 264/237; 425/72.2

[58] Field of Search ..... 19/299, 300; 28/185, 28/240, 241, 273; 264/12, 103, 176.1, 177.17, 177.19, 210.8, 211.14, 211.17, 237, 518, 290.5, DIG. 73, DIG. 75; 425/66, 72.1, 72.2, 80.1, 81.1, 82.1, 83.1, 140, 141, 172, 462, 464

[56] References Cited

U.S. PATENT DOCUMENTS

| | | | |
|---|---|---|---|
| 2,881,471 | 4/1959 | Snow et al. | 425/72.2 |
| 2,982,994 | 5/1961 | Fernstrom | 425/72.2 |
| 3,070,839 | 1/1963 | Thompson | 425/72.2 |
| 3,274,644 | 9/1966 | Massey et al. | 425/72.2 |
| 3,684,416 | 8/1972 | Lenk | 425/72.2 |
| 3,707,593 | 12/1972 | Fukada et al. | 425/72.2 |
| 3,787,195 | 1/1974 | Kirchheim | 264/115 |
| 3,802,817 | 4/1974 | Matsuki et al. | 425/66 |
| 3,812,553 | 5/1974 | Marshall et al. | 425/81.1 |
| 3,963,392 | 6/1976 | Goyal | 425/83.1 |
| 3,969,462 | 7/1976 | Stofan | 264/237 |
| 3,988,086 | 10/1976 | Marshall et al. | 425/72.2 |
| 4,017,580 | 4/1977 | Barbey | 425/66 |
| 4,025,595 | 5/1977 | Mirhej | 264/103 |
| 4,035,464 | 7/1977 | Kubitzek et al. | 264/210.8 |
| 4,035,883 | 7/1977 | Bond | 264/210.8 |
| 4,141,772 | 2/1979 | Buell | 425/81.1 |
| 4,217,078 | 8/1980 | Buell | 425/81.1 |
| 4,285,646 | 8/1981 | Waite | 425/72.2 |
| 4,318,676 | 3/1982 | Gerking et al. | 425/72.2 |
| 4,340,563 | 7/1982 | Appel et al. | 264/518 |
| 4,350,482 | 9/1982 | Alexandrov et al. | 425/83.1 |
| 4,388,056 | 6/1983 | Lee et al. | 425/83.1 |
| 4,442,062 | 4/1984 | Fujii et al. | 264/518 |
| 4,553,996 | 11/1985 | Muschelknautz et al. | 425/80.1 |
| 4,612,150 | 9/1986 | De Howitt | 264/103 |
| 4,692,106 | 9/1987 | Grabowski et al. | 264/211.14 |

FOREIGN PATENT DOCUMENTS

| | | | |
|---|---|---|---|
| 1435476 | 3/1969 | Fed. Rep. of Germany | 264/237 |
| 2049594 | 1/1972 | Fed. Rep. of Germany . | |
| 1950435 | 4/1975 | Fed. Rep. of Germany . | |
| 2658518 | 6/1978 | Fed. Rep. of Germany | 264/40.3 |
| 2906618 | 8/1980 | Fed. Rep. of Germany | 264/237 |
| 3400847 | 8/1985 | Fed. Rep. of Germany . | |
| 3406346 | 8/1986 | Fed. Rep. of Germany . | |
| 43-15574 | 7/1968 | Japan | 264/237 |
| 47-50003 | 12/1972 | Japan | 425/72.2 |
| 51-007204 | 3/1976 | Japan | 264/103 |

*Primary Examiner*—Jay H. Woo
*Assistant Examiner*—C. Scott Bushey
*Attorney, Agent, or Firm*—Herbert Dubno

[57] ABSTRACT

The apparatus has a spinneret, a cooling shaft, a stretching aperture, a diffuser shaft, a fleece receiving conveyor and a device for feeding process air and for pulling or drawing outflowing air through the fleece receiving conveyor. The cooling shaft has a shaft wall provided with a plurality of air orifices. Process air required for the cooling is fed into the cooling shaft. The cooling shaft is provided with an upper intensive cooling region and a lower additional cooling region and suitable air flow dividing guiding walls connected to the outside of the shaft wall. Air control flaps which have an outlet gap opening to the stretching aperture and which form a wedge pointing in the feed direction of the endless filament are connected upstream of the stretching aperture to the shaft walls. The diffuser shaft is provided with pivoting wings defining the passage cross section which are each movable about one horizontal axis. The device for pulling or drawing outflowing air has an adjustable damper above and/or below the fleece delivery conveyor with which the width of the outflowing air measured in the transport direction is adjustable. The apparatus operates with a single process air flow which is dividable into one partial flow for the intensive cooling region and another partial flow for the additional cooling region.

5 Claims, 1 Drawing Sheet

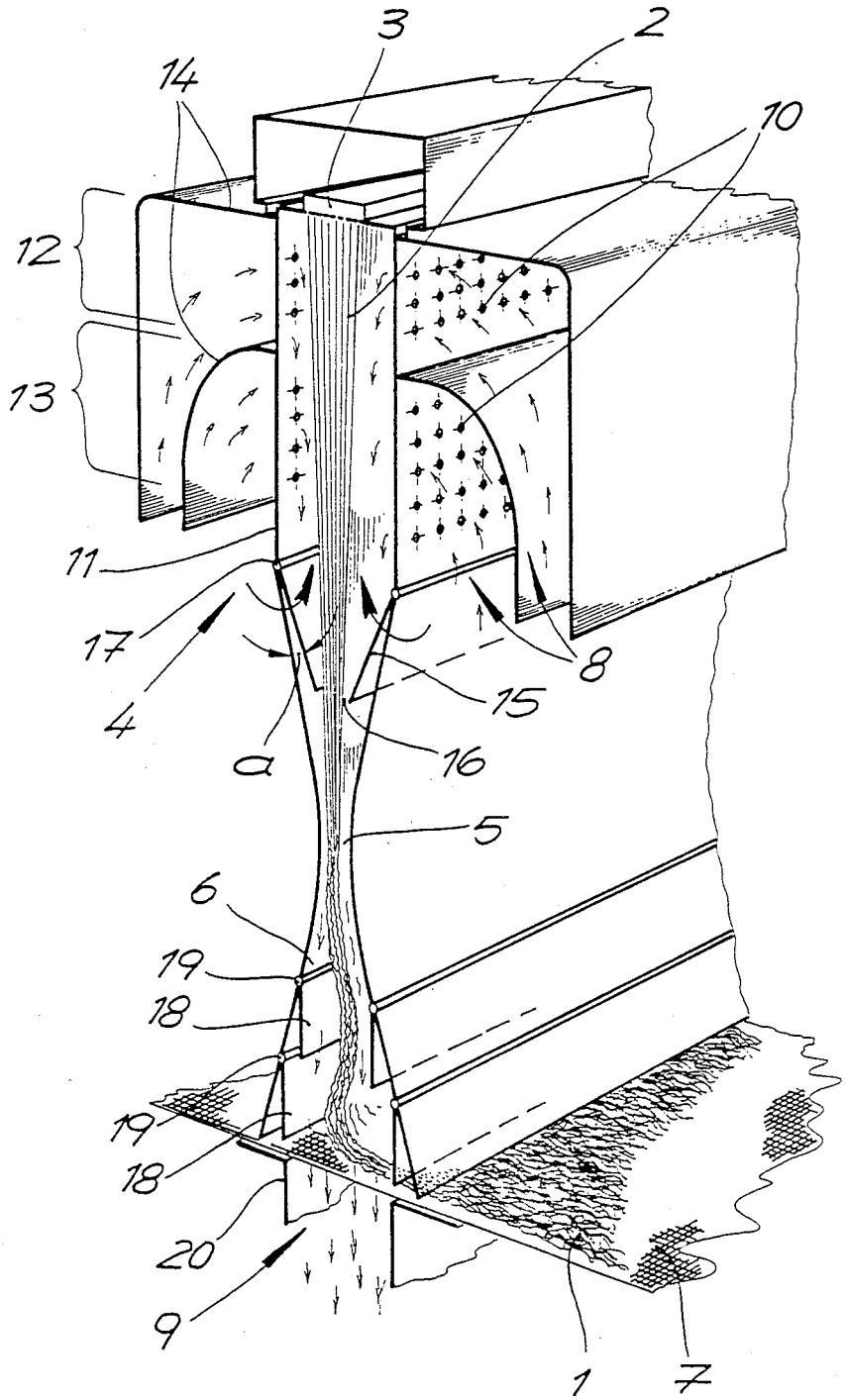
3
2
14
10
12
13
11
17
4
a
8
15
16
5
6
19
18
19
18
20
9
1
7

APPARATUS FOR MAKING A SPUN-FILAMENT FLEECE

Field of the Invention

My present invention relates to an apparatus for making a spun-filament fleece from a endless synthetic resin resin filament.

BACKGROUND OF THE INVENTION

An apparatus for making a spun-filament fleece from a synthetic resin endless filament comprises a spinning nozzle system, a cooling shaft, a stretching aperture, a diffuser shaft, a fleece receiving conveyor and a device for feeding process air and for drawing outflowing air through the fleece delivery conveyor. The cooling shaft has a shaft wall provided with a plurality of air orifices. Process air required for cooling is introduced through these air orifices.

In this apparatus the stretching aperture can be adjustable in regard to its size or can be of a fixed size. The undivided band of endless filaments is spun out of a single spinning nozzle system or staggered groups of spinning nozzles.

The apparatus for making the spun-filament fleece must be operated so that an endless spun-filament fleece with very uniform properties and quality over the entire fleece width and fleece length results. Moreover care must be taken so that a change to another product, i.e. to another material for the endless filaments, and to other physical properties and qualities is possible without difficulty.

In practice in the known apparatus the described components are installed as fixed components and are operable but are not adjustable or controllable when a change to another product is made. The required adjustment occurs by the process air. The known apparatus operates with three air flows, namely an air flow for cooling, a stretching air flow and a diffuser air flow. That is expensive.

OBJECTS OF THE INVENTION

It is an object of my invention to provide an improved apparatus for making a spun-filament fleece, especially from a synthetic resin filament which will overcome the above-mentioned drawbacks.

It is also an object of my invention to provide an improved apparatus for making a spun-filament fleece in which control and adjustment to very uniform product physical properties and standards of quality must be made.

It is another object of my invention to provide an improved apparatus for making a spun-filament fleece in which control and adjustment of the apparatus for other products no longer must involve manipulations with three separate air flows and by the process air flow.

SUMMARY OF THE INVENTION

These objects and others which will become more readily apparent hereinafter are attained in accordance with my invention in an apparatus for making a spun-filament fleece from an endless synthetic resin filament comprising a spinning nozzle or spinneret system, a cooling shaft, a stretching aperture, a diffuser shaft, a fleece receiving conveyor and a device for feeding process air and for drawing outflowing air through the fleece receiving conveyor. The cooling shaft has a shaft wall provided with a plurality of air orifices and process air required for cooling is introducable through the air orifices to provide an air flow.

According to my invention in combination:

(a) the cooling shaft is provided with an upper intensive cooling region and a lower additional cooling region as well as at least one suitable air flow dividing guiding wall connected to the outside of the shaft wall;

(b) a plurality of air control flaps, each pair forming a wedge directed downstream in the direction of motion of the endless synthetic resin filament and having an outlet opening to the stretching chamber, are connected upstream of the stretching aperture to the shaft wall;

(c) the diffuser shaft is provided with a plurality of pivoting wings defining the passage cross section each of which are movable about one horizontal axis; and (d) a device for drawing outflowing air has a slidable damper above and/or below the fleece receiving conveyor with which the width of the outflowing air flow measured in the transport direction of the fleece receiving conveyor is adjustable so that a single process air flow results which is dividable into one partial flow for the upper intensive cooling region and into another additional partial flow for the additional cooling region.

In an advantageous feature of my invention the air flow dividing guiding wall is of an adjustable height and because of that the height of the upper intensive cooling region is adjustable.

According to another desirable feature of my invention the air control flaps have an adjustable setting angle and are movable about another horizontal axis. The setting angle of each of the air control flaps is controllable and/or adjustable differently over the entire length thereof transverse to the motion direction of the endless filaments, e.g. by virtue of the ability of each flap to flex and twist about a longitudinal axis thereof.

Generally the device of my invention is formed so that the diffuser shaft has the pivoting wings arranged in a plurality of steps over each other and the pivoting wings so arranged are adjustable independently of each other.

In the apparatus according to my invention the component parts which are mentioned in features (a) to (d) above are adjustable and/or fixable and of course so that a spun-filament fleece arises which is characterized by very uniform physical properties and quality over its entire width and length.

Moreover a change to another fleece product is possible in a simple way so that that product is also characterized by very uniform homogeneous physical properties and qualities.

In the apparatus according to my invention only a single air flow is required. Its entire flow rate is divided between an intensive cooling region and an additional cooling region.

In the intensive cooling region the necessary air flow can be fed in with the maximum possible air speed. In this way disturbing turbulence and filament clogging can be avoided.

Any additional air which may be needed for the process air is fed in as additional cooling air.

By adjusting the air control flaps inhomogeneities in the physical properties over the spun-filament fleece width may be excluded. Particularly by different adjustment of the setting angle of the air control flaps over their length transverse to the feed direction of the endless filaments, the edge regions of the spun-filament fleece have the desired physical properties and quality.

Within the scope of my invention the edges of the air control flaps are provided with sectioning, indentations and similar shaping.

In any case one can attain a very precise adjustment of the surface weights. It is particularly advantageous that the surface weight (weight of fleece per unit area) can be kept constant by a control device which works with an electronic device for determining the surface weight and with an adjustment of the air control flaps.

The pivoting wings defining the passage cross section together with the damper adjustment of the width of the outflowing air allow a very precise control of the loop formation and thereby control of the deposited length of the filaments in the production direction.

The described effects can be attained in devices of other kinds in which the appropriate features are realized. Thus the feature (b) as well as the combination of the features (c) and (d) acquire an independent significance.

BRIEF DESCRIPTION OF THE DRAWING

The above and other objects, features and advantages of my invention will become more readily apparent from the following description, reference being made to the accompanying highly diagrammatic drawing in which the sole FIGURE is a perspective view of a vertically cutaway portion of an apparatus for making a spun-filament fleece according to my invention.

SPECIFIC DESCRIPTION

The unit or apparatus shown in the drawing produces a spun-filament fleece 1 made from endless synthetic resin filaments 2.

This unit comprises a spinning nozzle or spinneret system 3, a cooling shaft 4, a stretching aperture 5, a diffuser shaft 6 and a fleece receiving conveyor 7. In addition devices 8, 9 are provided for feeding process air and for drawing outgoing air through the fleece receiving conveyor 7. The cooling shaft 4 has a shaft wall 11 provided with air orifices 10. The shaft wall 11 however can also be formed as a flow directing device in the form of a screen or grid. As a consequence, process air required for cooling can be introduced into the cooling shaft 4.

The cooling shaft 4 has an upper intensive cooling region 12 and a lower additional cooling region 13 as well as suitable air flow dividing guiding walls or baffles 14 connected to the outside of the shaft wall 11. The air flow dividing guiding walls 14 are of adjustable height and thereby the height of the intensive cooling region 12 is similarly adjustable.

Air control flaps 15, each opposing pair converging like a wedge in the motion direction of the endless synthetic resin filaments 2 and connected to the shaft wall 1!, are connected in series with the stretching aperture 5. These pairs of air control flaps 15 have an outlet gap 16 which opens to the stretching aperture 5.

These air control flaps 15 each have an adjustable setting angle a and are each movable about another horizontal axis 17 as is indicated in the figure by the curved arrows. The arrangement is set forth so that the setting angles a and thus the width of the outlet gap 16 is adjustable differently over the entire length of the flexible air control flaps 15. For this purpose conventional servomotors can be provided as adjusting elements.

The diffuser shaft 6 is provided with pivoting wings 18 defining the flow cross section, the wings being movable about one horizontal axis 19. Opposing pairs are positioned above each other in several steps and are adjustable independently of one another. Also they can be set at different setting angles with suitable adjusting elements.

The device 9 for drawing outflowing air has an adjustable damper 20 above and/or below the fleece receiving conveyor 7 with which the width of the outflowing, air flow measured in the transport direction of the fleece receiving conveyor 7 is adjustable.

It can be operated with a closed or partially closed air flow for the process air and for the outflowing air. In any case the apparatus according to my invention does not operate with three separate air flows but with a single process air flow Which, as described, is divided into a partial flow of air for the intensive cooling region 12 and a partial air flow for the additional cooling region 13.

By the device for feeding process air I mean the shaft wall 11 with the air orifices 10, the baffles or flow dividing guiding walls 14 and other similar items as well as an unillustrated air blower or pump.

I claim:

1. In a fleece spinning apparatus for making a spun-filament fleece from an endless synthetic resin filament comprising a spinning nozzle system, a cooling shaft disposing immediately below said spinning nozzles system a stretching aperture downstream of said cooling shaft, a diffuser shaft, downstream of said aperture, a fleece receiving conveyor and a device for feeding process air and for drawing outflowing air through said fleece receiving conveyor, said cooling shaft having a shaft wall provided with a plurality of air orifices and said process air required for cooling being introduced through said air orifices to provide an air flow, the improvement wherein in combination:

(a) said cooling shaft is provided with an upper intensive cooling region and a lower additional cooling region as well as at least one suitable air flow dividing guiding wall connected to the outside of said shaft wall, and said guiding wall is of an adjustable height enabling adjustment of the height of said intensive cooling region;

(b) a plurality of opposing pairs of air control flaps, each opposing pair together forming a wedge directed downstream in the direction of motion of said endless synthetic resin filament and having an outlet opening to said stretching aperture, are connected to said shaft wall upstream of said stretching aperture, (c) said diffuser shaft is provided with a plurality of pivoting wings defining a passage cross section, each of said wings being movable about one horizontal axis; and (d) said device for drawing said outflowing air has a slidable damper below said fleece receiving conveyor with which the width of the flow of said outflowing air measured in the transport direction of said fleece receiving conveyor is adjustable so that a single flow of said process air results which is dividable into one partial flow for said upper intensive cooling region and into another additional partial flow for said additional cooling region.

2. The improvement defined in claim 1 wherein said air control flaps each have an adjustable setting angle and are movable each about a respective further horizontal axis.

3. The improvement defined in claim 2 wherein said setting angle of each of said air control flaps is adjustable differently over the entire length thereof transverse to said motion direction of said endless synthetic resin filament.

4. The improvement defined in claim 1 wherein said diffuser shaft has said pivoting wings arranged in a plurality of steps over each other and said pivoting wings so arranged are adjustable independently of each other.

5. A fleece spining apparatus for making a spun-filament fleece comprising:

a spinning nozzle system;

a cooling shaft provided with a stretching aperture, said cooling shaft having a shaft wall provided with a plurality of air orifices and process air required for cooling being introducable through said air orifices to provide an air flow and said cooling shaft also having an upper intensive cooling region and a lower additional cooling region as well as at least one suitable air flow dividing guiding wall connected to the outside of said shaft wall, said air flow dividing guiding wall being of an adjustable height thereby enabling adjustment of the height of said intensive cooling region;

a diffuser shaft;

a fleece receiving conveyor;

a device for feeding process air and for drawing outflowing air through said fleece receiving conveyor, said air flow being at least partially drawable through said fleece receiving conveyor;

at least two opposing pivoting wings which are each movable about one horizontal axis being provided in said diffuser shaft;

a plurality of opposing pairs of air control flaps whose setting angles are adjustable against said air flow, each opposing pair together forming a wedge directed downstream in the direction of motion of said endless synthetic resin filament and having an outlet opening to said stretching aperture, connected upstream of said stretching aperture to said shaft wall; and an adjustable damper below said fleece receiving conveyor combined with said device for feeding said process air and for drawing said outflowing air with which the width of said air flow measured in the transport direction of said fleece receiving conveyor is adjustable.

* * * * *